US007942495B2

(12) United States Patent
Boyd

(10) Patent No.: US 7,942,495 B2
(45) Date of Patent: May 17, 2011

(54) METHOD OF AND APPARATUS FOR INK JET PRINTING USING AN ELECTROSTATIC FIELD

(75) Inventor: Scott A. Boyd, White Bear Lake, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 350 days.

(21) Appl. No.: 12/348,624

(22) Filed: Jan. 5, 2009

(65) Prior Publication Data

US 2009/0174755 A1 Jul. 9, 2009

Related U.S. Application Data

(60) Provisional application No. 61/019,783, filed on Jan. 8, 2008.

(51) Int. Cl.
*B41J 2/015* (2006.01)
*B05B 7/00* (2006.01)
*B05B 7/06* (2006.01)

(52) U.S. Cl. ..... 347/21; 118/300; 118/313

(58) Field of Classification Search ..... 347/20, 347/21, 37, 39, 40, 42, 44, 73–74, 76–77, 347/82; 118/62–65, 67, 68, 300, 313, 413, 118/419, 420, 424

See application file for complete search history.

(56) References Cited

U.S. PATENT DOCUMENTS

| | | | | |
|---|---|---|---|---|
| 2,952,559 | A | 9/1960 | Nadeau | |
| 3,052,131 | A | 9/1962 | Reliford | |
| 3,206,323 | A | 9/1965 | Miller et al. | |
| 4,837,045 | A | 6/1989 | Nakajima | |
| 5,609,923 | A | 3/1997 | Clarke | |
| 5,944,893 | A | 8/1999 | Anderson | |
| 5,972,111 | A * | 10/1999 | Anderson | 118/300 |
| 6,089,160 | A | 7/2000 | Anderson | |
| 6,090,445 | A | 7/2000 | Anderson | |
| 6,190,454 | B1 * | 2/2001 | Anderson | 118/300 |
| 6,319,555 | B1 | 11/2001 | Anderson | |
| 6,398,869 | B1 * | 6/2002 | Anderson | 118/300 |
| 6,786,971 | B2 | 9/2004 | Anderson | |

FOREIGN PATENT DOCUMENTS

| | | |
|---|---|---|
| WO | WO 89/05477 | 6/1989 |

* cited by examiner

*Primary Examiner* — K. Feggins

(57) ABSTRACT

An improved printer and method of printing uses an electrostatic field at the point of ink contact with the print medium to improve ink application. This improved printer and printing method makes possible a higher resolution final image; provides for greater control of the application of ink on the print medium; permits the use of a wider range of inks having variable viscosities, surface tensions, and elasticities; and permits the use of a variety of ink application speeds.

2 Claims, 3 Drawing Sheets

METHOD OF AND APPARATUS FOR INK JET PRINTING USING AN ELECTROSTATIC FIELD

CROSS REFERENCE TO RELATED APPLICATION

This application claims the benefit of U.S. Provisional Patent Application No. 61/019,783, filed Jan. 8, 2008, the disclosure of which is incorporated by reference herein in its entirety.

BACKGROUND

One known printer technology includes a print head that (1) immerses a wire in a reservoir of pigmented liquid material (e.g., ink) for a period of time sufficient to allow the wire to be coated with ink, (2) places the coated wire in close proximity to a print medium, and (3) directs a stream of air to contact the coated wire and thereby causes at least some of the ink on the wire to be deposited onto the print medium. The speed of the wire, the proximity of the wire to the print medium, and the force of the air stream may be digitally controlled by a processor, controller, microprocessor, or other computing device to ensure that a desired image resolution is achieved. By forming a print head with multiple wires; multiple, differently colored ink reservoirs; and multiple air streams, and by controlling and coordinating the metering of the ink and the position of the print head in relation to the print medium, a digital image can be created on a large-sized print medium. U.S. Pat. Nos. 5,944,893; 5,972,111; 6,089,160; 6,090,445; 6,190,454; 6,319,555; 6,398,869; and 6,786,971 describe this printer technology in greater detail and are hereby incorporated by reference.

FIG. 1 is a perspective view of one embodiment of the above-identified prior art single color ink injector, generally indicated at 10, for depositing paint, ink, dye, or other liquid pigmented material that could be used for painting or printing onto a print medium. A pulley 13 having a circumscribing groove 38 defined therein is secured to a shaft 15 of a motor 14. An elongate frame member 32 depends from and is secured to print medium 12 and extends into a reservoir of ink 24. A rotatable or stationary guide 34 is attached to a distal end 37 of elongate frame member 32. Guide 34 is illustrated as a cylindrical, non-rotatable member having a groove 40 circumscribing guide 34 in which a wire cable 36, can slide during rotation of wheel 13. Wire cable 36 is described in greater detail in the above-identified patents. Wire cable 36 is disposed in groove 38 circumscribing the wheel 13 and in groove 40 circumscribing guide 34.

An elongate reservoir retaining member 16 is attached to plate 12 and includes a flange 18 defining a notch 20 between the flange 18 and elongate reservoir retaining member 16. Notch 20 is configured to receive a top lip 22 of ink reservoir 24. A bottom plate 26 is secured to a distal end 28 of elongate reservoir retaining member 16 with a threaded nut 31 that is threaded onto a threaded shaft 33. Threaded shaft 33 is secured to distal end 28 of elongate reservoir retaining member 16. Bottom plate 26 abuts against the bottom 30 of the ink reservoir 24 and holds it between flange 18 and bottom plate 26.

An air supply hose 42 is secured to a nozzle body 44 and supplies air through a nozzle orifice 46 that is aimed at a portion of cable 36. A cable guide 48 defining a longitudinal slot 50 is positioned proximate nozzle orifice 46. Cable 36 rides within slot 50 and is thus held in relative position to nozzle orifice 46 so that air passing therethrough does not substantially move cable 36 from in front of nozzle orifice 46 or cause cable 36 to substantially vibrate.

Rotation of shaft 15 is controlled by a controller, generally indicated at 57, comprising circuitry 54 in a module 56 that receives signals from a signal generating device 52, such as a personal computer employing a microprocessor or other devices that can supply discrete signals to instruct selective rotation of the shaft 15 of the motor. Circuitry 54 receives a signal(s) from generating device 52 and rotates shaft 15 of the motor according to the signal(s).

In operation, ink contained in reservoir 24 is picked up by cable 36 and advanced by rotation of wheel 13, indicated by the arrow, in front of nozzle orifice 46. Air that is blown through nozzle orifice 46 disperses or pulls ink from cable 36 toward the print medium. Depending on the viscosity of the ink, the cross-sectional diameter of cable 36, and the diameter of wheel 13, a relatively precise amount of ink can be deposited on print medium. Such an apparatus may produce images having a resolution of approximately 50 dpi or better.

FIG. 2 is a side view of the prior art single color ink injector of FIG. 1.

SUMMARY

The present application is directed to a method of increasing the accuracy with which the ink is applied to the print medium.

The present application is directed to a method of forming a high resolution image on the print medium.

An improved printer and method of printing uses an electrostatic field at the point of ink contact with the print medium to improve ink application. This improved printer and printing method makes possible a higher resolution final image; provides for greater control of the application of ink on the print medium; permits the use of a wider range of inks having variable viscosities, surface tensions, and elasticities; and permits the use of a variety of ink application speeds.

One embodiment of a method involves coating at least a portion of an exterior surface of a cable with an electrostatically charged, pigmented material and directing an air stream at the portion of the cable coated with the pigmented material. The force of air in the air stream causes a metered amount of the electrostatically charged, pigmented material to be removed from the exterior surface of the cable and to be deposited onto a print medium that is placed in close proximity to the cable. Advancement of the cable through the air stream is electronically controlled. The electrostatically charged print medium and the electrostatically charged, pigmented material have opposite charges such that they are attracted to one another at a location where the electrostatically charged, pigmented material is removed from the exterior surface of the cable and is deposited onto the print medium.

One embodiment of an apparatus for digitally printing a high resolution image on a print medium includes a support structure, a carriage associated with and movable in at least one direction relative to the support structure, and a plurality of paint injectors secured to the carriage. Each of the paint injectors includes a motor having a rotatable shaft, a wheel rotatable by the shaft, an idler, and an elongate segment (or cable) disposed around at least a portion of the wheel and a portion of the idler. The elongate segment is advanceable by the wheel and has a quantity of charged, pigmented material coated onto at least a portion of it. The paint injectors also each include at least one fluid nozzle positioned and oriented for directing a jet of fluid toward at least a portion of the elongate segment to remove an amount of electrostatically charged, pigmented material from the elongate segment and direct the amount toward a surface of an electrostatically charged print medium. A controller that is electronically connected to each motor controls the rotation of each wheel and controls the position of the carriage relative to the support structure. The electrostatically charged print medium and the electrostatically charged, pigmented material have opposite charges such that they are attracted to one another at a location where the electrostatically charged, pigmented material is directed toward the surface of the electrostatically charged print medium.

DETAILED DESCRIPTION

Electrostatic coating applications involve applying an electrostatic charge to at least one of the ink and/or the print medium such that the ink and print medium are electrostatically attracted to one another due to their charged states. The ink is thus pulled toward the print medium with added force, facilitating greater control and/or improvement of certain variables relating to the application of the ink to the print medium, such as, for example, ink droplet diameter, resolution of the final image, and consistency of ink droplet size across the image. A wide variety of electrostatic coating methods and systems are known in the art and may be used in connection with the printer described above. A list of exemplary patents that describe some of these exemplary methods and systems are as follows: U.S. Pat. Nos. 3,052,131; 2,952,559; 3,206,323; 4,837,045; 5,609,923 and EP 390774 B1.

Some specific exemplary electrostatic coating methods and assemblies are described below. However, the invention is not meant to be limited to the specific methods and embodiments described below.

One method of using an electrostatic field at the point of ink contact with the print medium to improve ink application involves precharging the print medium (applying a charge to the print medium before the ink is applied). As is known to those of skill in art, precharging can be accomplished in a variety of ways, such as, for example, use of a corona wire and use of charged brushes.

Figure 1:
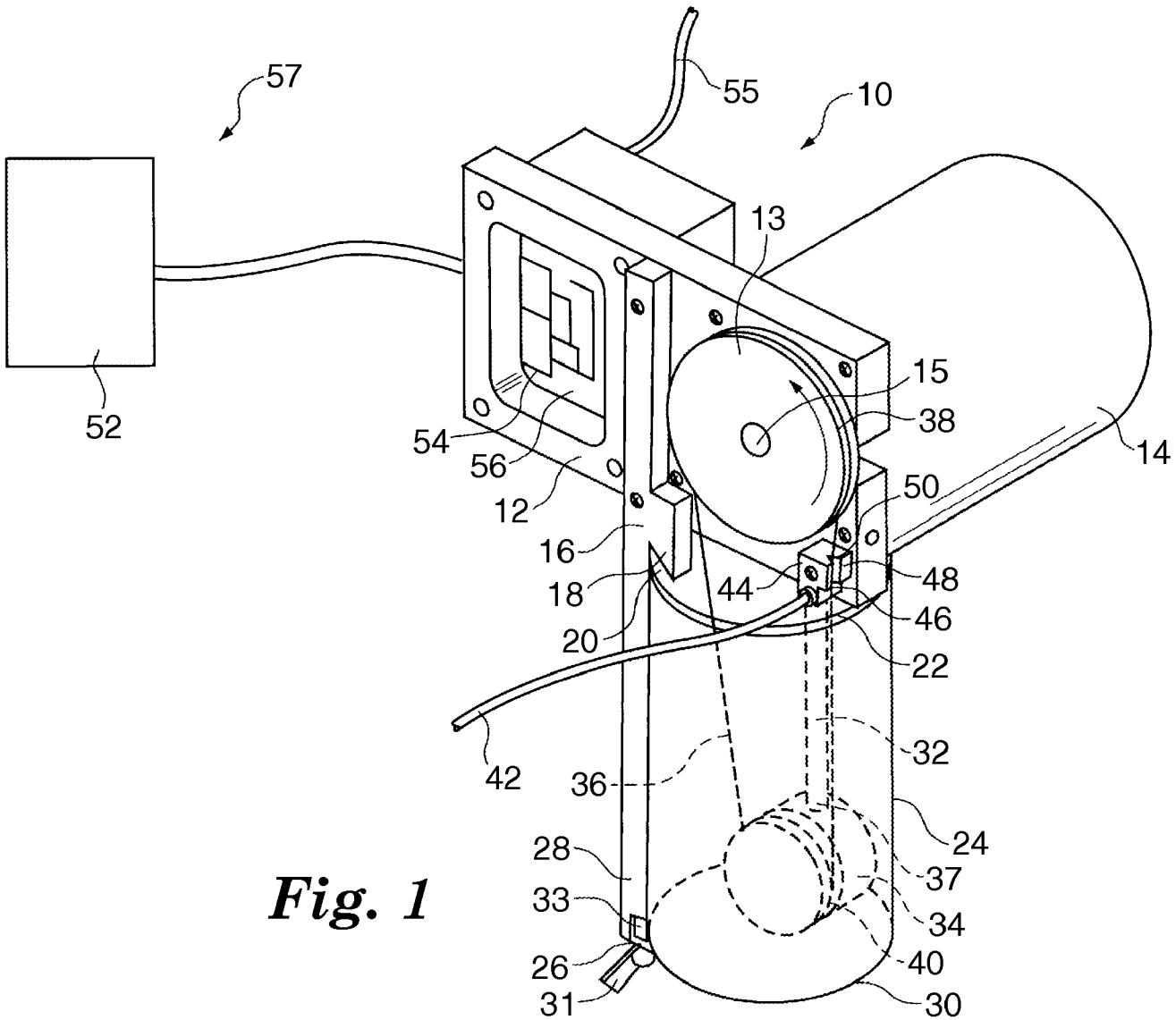
FIG. 1 is a perspective view of one embodiment of a prior art single color ink injector.
Figure 2:
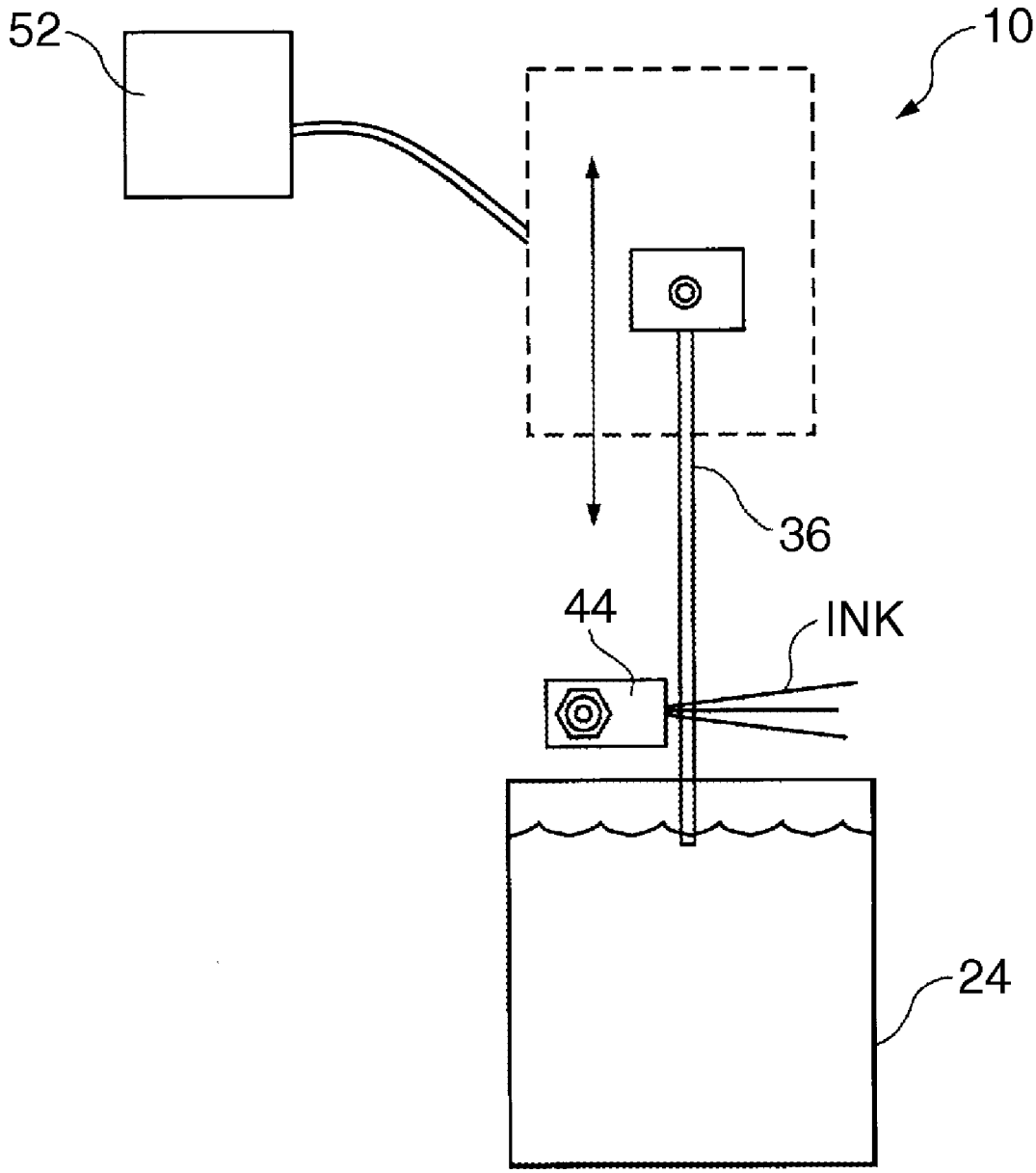
Fig. 2 PRIOR ART
FIG. 2 is a side view of the prior art single color ink injector of FIG. 1.
Figure 3:
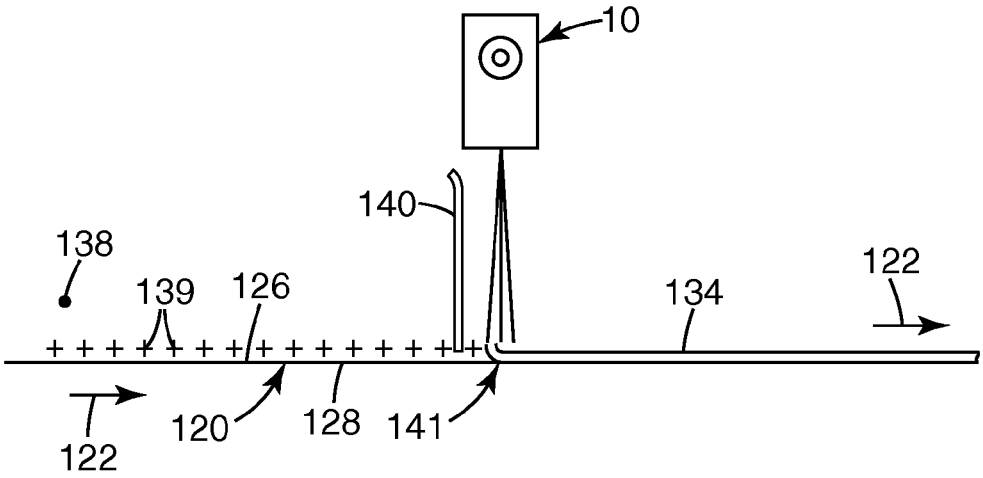
FIG. 3 is a schematic view of a printer including one embodiment of an electrostatic coating apparatus.

FIG. 3 shows one exemplary method of and apparatus for an electrostatic coating application in connection with the prior art single color ink injector of FIGS. 1 and 2. In FIG. 3, electrostatic charges are applied to a first side 126 of a print medium 120 at a charge application station 136 spaced longitudinally upstream from a print head 124 of a type described above. The charges could alternatively be applied to a second side 128 of print medium 120. At charge application station 136, a laterally disposed corona discharge wire 138 applies positive (or negative) electrical charges 139 to print medium 120. Wire 138 can be on either of first or second side 126 or 128 of print medium 120. The ink 132 that is applied to print medium 120 is grounded (such as by print head 124), and is electrostatically attracted to the charged print medium 120. Optionally, a laterally disposed air dam 140 can be disposed adjacent and upstream of print head 124 to reduce print medium 120 boundary layer air interference at a print head-print medium interface 141. Wire 138 could be aligned in free space along print medium 120 (as is shown in FIG. 3) or, alternatively, could be aligned adjacent first side 126 of print medium 120 while the print medium is in contact with a backing roll at interface 141.

Another method of using an electrostatic field at the point of ink contact with the print medium to improve ink application involves energizing a support structure adjacent to the print medium. As is known to those of skill in art, energizing the support structure can be accomplished in a variety of ways, such as, for example, using conductive elevated electrical potential rolls, using nonconductive roll surfaces that are precharged, and using powered semiconductive rolls.

Figure 4:
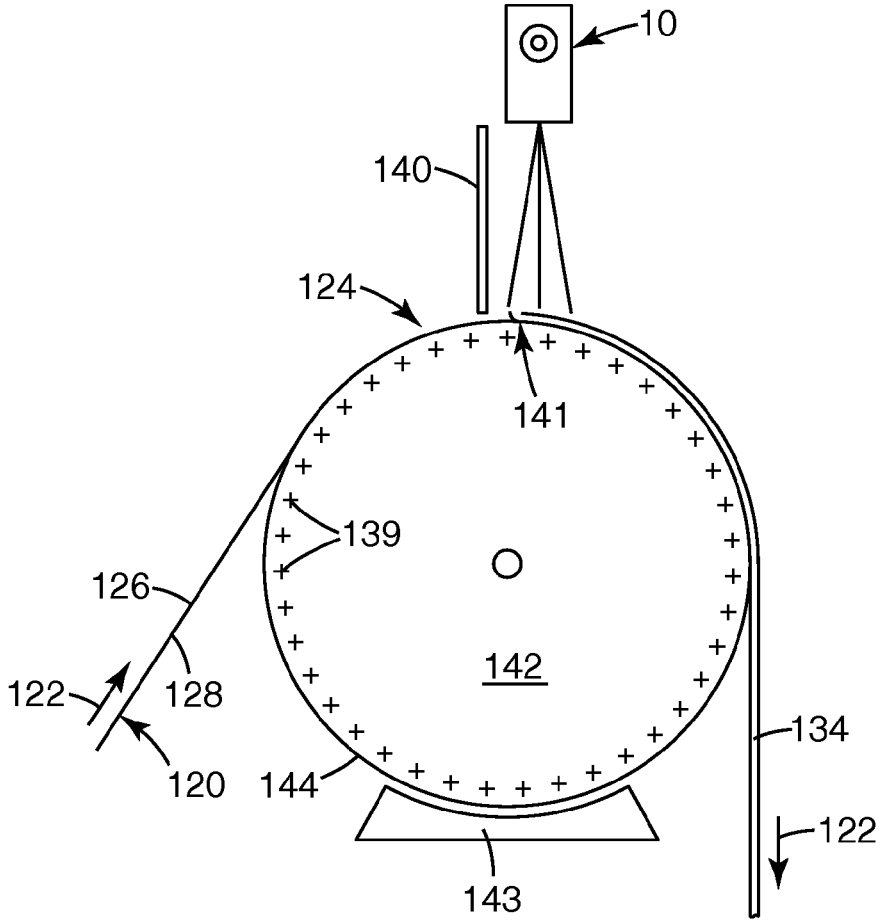
FIG. 4 is a schematic view of a printer including another embodiment of an electrostatic coating apparatus.

FIG. 4 shows this alternative exemplary method of and apparatus for an electrostatic coating application in connection with the prior art single color ink injector of FIGS. 1 and 2. In FIG. 4, a relatively large diameter backing roll 142 supports second side 28 of print medium 120 at print head-print medium interface 141. Backing roll 142 can be, for example, a charged dielectric roll, a powered semiconductive roll, or a conductive roll. The conductive and semiconductive rolls can be charged, for example, by a high voltage power supply. With a dielectric roll, the roll can be provided with electrical charges by suitable means, such as a corona charging assembly 143. Regardless of the type of backing roll 142 or its means of being charged, its outer cylindrical surface 144 is adapted to deliver electrical charges 139 to second side 128 of print medium 120. As is shown in FIG. 4, electrical charges 139 from backing roll 142 are positive charges, and ink 132 is grounded by grounding print head 124. Accordingly, ink 132 is electrostatically attracted to charges residing at the interface between print medium 120 and the outer cylindrical surface 144 of roll 142. Optional air dam 140 reduces web boundary layer air interference at the print head-print medium interface 141.

As shown above, the ink stream is aligned with the gravitational vector. Those of skill in the art will recognize that it can be aligned at other angles that are not specifically shown. Also, the printer and printing method can be used to form a continuous or discontinuous coating. Further, although the examples show a print medium moving past a stationary print head, the print medium can be stationary while the print heads moves, or both the print medium and print head can move relative to one another or to a fixed point.

As used herein, the term "cable" is meant to include the use of a wire, a cable formed of multiple wires, a rod, a saw tooth wheel, or variations thereof.

As used herein, the term "ink" is meant to include any pigmented material, including, but not limited to, inks, dyes, paints, or other similarly pigmented liquids. Inks that can be printed in the printer of the present invention include inks having a viscosity between about 200 and about 2000. This is a still significantly higher viscosity than can be jetted though conventional ink jet printers. A list of exemplary commercially available inks that fall within this range includes: 3M Process Color Series 700, 3M Process Color Series 880-00, 3M Process Color Series 880i, 3M Process Color Series 990, 3M Scotchlite Transparent Screen Printing Ink Series 2900, 3M Screen Printing Ink Series 1900, 3M Screen Printing Ink Series 9700UV, Nazdar 3500 Series UV Vinex Screen Ink, Avery Dennison Series 4930 Series Inks (10 year-1 Component Solvent Ink*), Sericol UVTS Series Ink, Nazdar UVTS Series Ink, Avery Dennison® UVTS-Sericol Ultraviolet Curable Printing Inks, Avery Dennison® UVTS-NazDar Ultraviolet Curable Printing Inks, Kiwalite KT Series Screen Process Ink, Avery Dennison® 10TS SeriesTwo-Component Printing Inks For Traffic Sign Products, Sericol Sinvacure UV Curable Screen Ink, Avery Dennison® 7TS Series Inks One Component Solvent Ink System For Traffic Sign Products, and Ink Dezyne VP-000 Series Vinyl Plus Screen Ink.

As used herein, the term "print medium" is meant to include any print medium known in the art, including but not limited to paper, plastic, synthetic paper, metal foil, vinyl, and films, and variations thereof.

Various modifications and alterations of the present invention will become apparent to those skilled in the art without departing from the spirit and scope of the invention.

What is claimed is:

1. A method of forming a high resolution image on a print medium, comprising:

coating at least a portion of an exterior surface of a cable with an electrostatically charged, pigmented material;

directing an air stream at the at least a portion of the cable coated with the pigmented material; and electronically controlling advancement of the cable through the air stream such that a metered amount of the electrostatically charged, pigmented material is removed from the exterior surface of the cable and is deposited onto a print medium that is placed in close proximity to the cable;

wherein the electrostatically charged print medium and the electrostatically charged, pigmented material have opposite charges such that they are attracted to one another at a location where the electrostatically charged, pigmented material is removed from the exterior surface of the cable and is deposited onto the print medium.

2. An apparatus for digitally printing a high resolution image on a print medium, comprising:

a support structure;

a carriage associated with and movable in at least one direction relative to the support structure;

a plurality of paint injectors secured to the carriage, each comprising:

a motor having a rotatable shaft;

a wheel rotatable by the shaft of the motor;

an idler;

an elongate segment disposed around at least a portion of the wheel and a portion of the idler and advanceable by the wheel, the elongate segment having a quantity of charged, pigmented material coated onto at least a portion of the elongate segment; and at least one fluid nozzle positioned and oriented for directing a jet of fluid toward the at least a portion of the elongate segment to remove an amount of electrostatically charged, pigmented material from the elongate segment and direct the amount toward a surface of an electrostatically charged print medium; and a controller electronically connected to each motor for controlling rotation of each wheel and for controlling the position of the carriage relative to the support structure;

wherein the electrostatically charged print medium and the electrostatically charged, pigmented material have opposite charges such that they are attracted to one another at a location where the electrostatically charged, pigmented material is directed toward the surface of the electrostatically charged print medium.

* * * * *